US006345159B1

(12) United States Patent
Suzuki

(10) Patent No.: US 6,345,159 B1
(45) Date of Patent: Feb. 5, 2002

(54) CHARGING APPARATUS AND IMAGE FORMING APPARATUS

(75) Inventor: Kazuo Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/536,458

(22) Filed: Mar. 28, 2000

(30) Foreign Application Priority Data

May 31, 1999 (JP) ..... 11-152830

(51) Int. Cl.[7] ..... G03G 15/02

(52) U.S. Cl. ..... 399/50; 250/325; 399/170; 399/171; 399/172

(58) Field of Search ..... 399/48, 50, 115, 399/168, 170, 171, 172; 250/324, 325, 326

(56) References Cited

U.S. PATENT DOCUMENTS 5,159,388 A * 10/1992 Yoshiyama et al. ..... 399/171 X
5,376,998 A 12/1994 Suzuki ..... 355/326
5,455,660 A * 10/1995 Kunzmann et al. ..... 399/171 X
5,774,768 A * 6/1998 Hazama et al. ..... 399/170
5,805,956 A * 9/1998 Kawai et al. ..... 399/48 X

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

The present invention relates to a corona charging apparatus for charging a body to be charged that has a discharge wire electrode to which a voltage is applied, a shield electrode having an opening opposed to the body to be charged, a grid electrode disposed in the opening, a power supply for applying a voltage to the grid electrode, and a constant voltage generating element electrically connected to the grid electrode, the constant voltage generating element generating predetermined voltage when current flows into the constant voltage generating element, and rated voltage of the constant voltage generating element is equal to or greater than the voltage applied to the grid electrode from the power supply.

13 Claims, 3 Drawing Sheets

CHARGING APPARATUS AND IMAGE FORMING APPARATUS

BACKGROUND OF THE INVENTION

1. Field of the Invention

The present invention relates to an image forming apparatus of electrophotographic type such as a copying machine, a printer and the like, and a corona charging apparatus used in such an image forming apparatus.

2. Related Background Art

FIG. 4 is a schematic constructural view showing an example of a conventional image forming apparatus using a corona charging apparatus (scorotron charging apparatus) as charging means.

The image forming apparatus comprises a drum-shaped electrophotographic photosensitive body (referred to as "photosensitive drum" hereinafter) 1 as a body to be charged (image bearing member), a scorotron charger (charging means) 2, an exposure device 3, a developing device 4, a corona transfer charger (transfer charger) 5, an electrostatic separating charger (separation charger) 6, a cleaning device 7, a pre-exposure lamp 8 and a surface potential sensor 31, which elements 2 to 8 and 31 are disposed around the photosensitive drum.

In this conventional case, the photosensitive drum 1 is an A-Si (amorphous silicon) photosensitive drum rotated at a predetermined peripheral speed (process speed) in a direction shown by the arrow R1.

The scorotron charger 2 has a grid electrode 2*a* and a discharge wire electrode 2*b* which are housed in a shield case 2*c* having an opening and serves to charge a surface of the photosensitive drum 1 by corona ions generated by corona discharging.

The exposure device 3 serves to apply image exposure L corresponding to image information inputted from an image scanner portion 10 to the surface of the photosensitive drum 1 charged by the scorotron charger 2. The exposure device 3 has a laser driver 19, a laser diode 20, a polygon mirror 21 and a reflection mirror 22. A laser beam (intensity-) modulated in correspondence to a time series electrical digital image signal corresponding to the image information inputted from the image scanner portion 10 through an image processing portion 18 is outputted from the laser diode 20, and the laser beam is scanned by the polygon mirror 21 rotated at a high speed. Then, by applying the image exposure L, through the reflection mirror 22, to a photo-conductive layer (not shown) on the surface of the photosensitive drum 1, an electrostatic latent image corresponding to the inputted image information is formed.

The image scanner portion 10 serves to read an original 12 rested on an original glass plate 11 by scanning the original by an illumination lamp 13 and to convert the image information into an electric signal by a photoelectric converting element (CCD) 16. Light reflected from the original 12 scanned by the illumination lamp 13 is introduced into mirrors 14*a*, 14*b*, 14*c* and is focused on the photoelectric converting element 16 by a focusing lens 15. After the electric signal form the photoelectric converting element 16 is digitalized by an A/D converter 17, the signal is converted into image signals having 256 gradients from 00 (00 hex) to 255 (FF hex) proportional to image density, which is in turn outputted to the laser driver 19 through the image processing portion 18.

The developing device 4 serves to visualize the electrostatic latent image as a toner image by adhering toner to the latent image at a developing position.

Next, an image forming operation of the image forming apparatus will be explained.

During image formation, the photosensitive drum 1 is rotated at the predetermined process speed in the direction shown by the arrow R1 by driving means (not shown), and the surface of the photosensitive drum is uniformly charged by the scorotron charger 2. Then, the image exposure L from the exposure device 3 is applied to the charged surface of the photosensitive drum 1, thereby forming the electrostatic latent image corresponding to the image information of the original 12. The toner is adhered to the latent image by a developing sleeve 4*a* to which developing bias having the same (negative) polarity as charging polarity of the photosensitive drum 1 is applied, the latent image is developed as the toner image.

When the toner image on the photosensitive drum 1 reaches a transfer nip portion between the photosensitive drum 1 and the corona transfer charger (transfer charger) 5, the toner image on the photosensitive drum 1 is transferred onto a transfer material P such as a paper sheet (fed from a sheet feeding cassette (not shown) to the transfer nip portion at a predetermined timing) by the corona transfer charger 5 to which transfer bias having (positive) polarity opposite to the polarity of the toner is applied. The transfer material P to which the toner image was transferred is separated from the photosensitive drum 1 by the electrostatic separating charger (separation charger) 6 and the separated transfer material is conveyed between a fixing roller 23*a* and a pressure roller 23*b* of the fixing device 23, where the toner image is thermally fixed to the transfer material by heat and pressure from the fixing roller 23*a* and the pressure roller 23*b*. Thereafter, the transfer material is discharged out of the image forming apparatus.

On the other hand, after the transferring, transfer residual toner remaining on the surface of the photosensitive drum 1 is removed and collected by the cleaning device 7. Further, residual charges on the surface of the photosensitive drum 1 is removed by the pre-exposure lamp 8, thereby preparing for a next image formation.

By the way, due to dispersion in manufacture of the photosensitive drums 1, there is also dispersion in charging abilities of the photosensitive drums. Further, the charging ability is charged by a change in the discharging property of the scorotron charger 2 and change in charging property of the photosensitive drum 1 due to long term use and change in environment in which the image forming apparatus is used.

Thus, in the above-mentioned image forming apparatus, in order to absorb the dispersion in charging ability of the photosensitive drum 1, the surface potential of the photosensitive drum 1 was measured by the surface potential sensor 31, and grid voltage applied from a grid power supply 30 to the grid electrode 2*a* of the scorotron charger 2 was changed on the basis of measurement information from the surface potential sensor 31 so that the surface potential of the photosensitive drum 1 was maintained to the desired potential.

Further, as is in the above-mentioned image forming apparatus, when the photosensitive drum 1 having the small charging ability such as the A-Si (amorphous silicon) photosensitive body is used, voltage is applied to the shield case 2*c* of the scorotron charger 2 to increase the charging efficiency. In order to simplify the construction of the scorotron charger 2, electrical communication is made so that the potential of the grid electrode 2*a* becomes the same as the potential of the shield case 2*c*.

By the way, in the above-mentioned image forming apparatus, the scorotron charger 2 is detachably attachable to the main body (not shown) of the image forming apparatus so that the charger can easily be exchanged and cleaned.

Further, the grid power supply 30 for applying the desired voltage to the grid electrode 2*a* and the shield case 2*c* of the scorotron charger 2 is provided in the main body (not shown) of the image forming apparatus, and there are a plurality of connectors and contacts in an electrical path from the grid power supply 30 to the grid electrode 2*a* and the shield case 2*c* of the scorotron charger 2.

In a condition that poor connection between the connectors or poor electric contact between the contacts occurs due to long term use and change in environment in which the image forming apparatus is used, i.e., in a condition that the supplying of electric power to the grid electrode 2*a* and the shield case 2*c* is interrupted, if the photosensitive drum 1 is charged by the scorotron charger 2, the charges generated by the corona discharging cannot flow into the grid electrode 2*a* and the shield case 2*c*.

As a result, many charges flow into the photosensitive drum 1, thereby damaging the photosensitive drum 1. Particularly, when the photosensitive drum 1 is the A-Si (amorphous silicon) photosensitive body, since the voltage resistance is small, the photosensitive layer may be destroyed to make the use of the photosensitive drum impossible.

SUMMARY OF THE INVENTION

An object of the present invention is to provide a corona charging apparatus and an image forming apparatus, in which, even if poor electrical connection occurs between a grid electrode and a power supply, a body to be charged is prevented from being damaged.

Another object of the present invention is to provide an image forming apparatus, in which, even if poor electrical connection occurs between a grid electrode and a power supply, surface potential of an image bearing member charged by a corona charging apparatus can be maintained to a desired range.

A further object of the present invention is to provide a corona charging apparatus and an image forming apparatus, in which, even if poor electrical connection occurs between a grid electrode and a power supply, current can flow into the grid electrode.

The other objects and features of the present invention will be apparent from the following detailed explanation referring to the accompanying drawings.

DESCRIPTION OF THE PREFERRED EMBODIMENTS

The present invention will now be explained in connection with embodiments thereof with reference to the accompanying drawings.

First Embodiment

Figure 1:
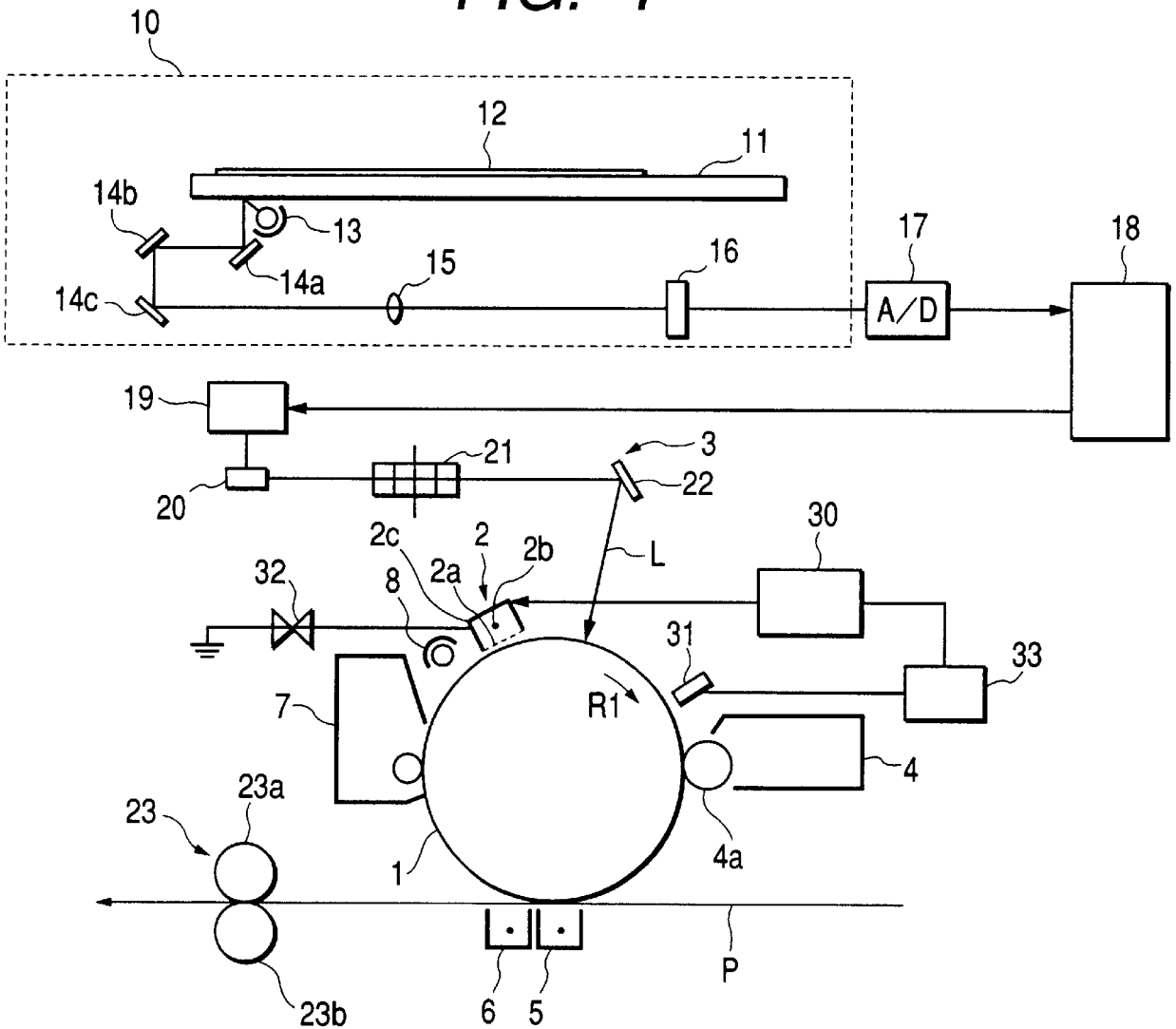
FIG. 1 is a schematic constructural view of an image forming apparatus according to first to third embodiments of the present invention.

FIG. 1 is a schematic constructural view of an image forming apparatus (copying machine) according to a first embodiment of the present invention. The same elements as those in the above-mentioned conventional image forming apparatus are designated by the same reference numerals and explanation thereof will be omitted. Also in the first embodiment, image formation is performed, as is in the above-mentioned conventional image forming apparatus. Thus, explanation of the image forming operation of the first embodiment will be omitted.

As mentioned above, the photosensitive drum 1 is the A-Si (amorphous silicon) photosensitive body, and electrical communication is made so that the potential of the shield case 2*c* of the scorotron charger 2 becomes the same as the potential of the grid electrode 2*a*. The purpose is that current directing from the discharge wire electrode 2*b* to the photosensitive drum is increased without increasing current applied to the discharge wire electrode 2*b*, by applying voltage to the shield case 2*c* which is normally grounded. Of course, although voltage may be applied to the shield case 2*c* from a power supply different from the power supply for applying the voltage to the grid electrode 2*a*, in consideration of cost and space, electrical communication between the shield case 2*c* and the grid electrode 2*a* is better and simpler.

Further, on the basis of the surface potential information of the photosensitive drum 1 inputted from the surface potential sensor 31, a control device 33 controls to apply desired voltage to the grid electrode 2*a* of the scorotron charger 2. That is to say, two different predetermined voltages are applied to the grid electrode 2*a* from the grid power supply 30, and the surface potentials of the photosensitive drum 1 in respective cases are measured by the surface potential sensor 31, and a relationship between the measured values is approximated linearly to calculate grid potential for obtaining the desired surface potential of the photosensitive drum 1 (drum potential). The control device 33 controls the grid power supply 30 on the basis of a relationship between the calculated grid potential and the drum potential to apply the desired voltage to the grid electrode 2*a* of the scorotron charger 2.

The grid potential can have a certain range of voltage to cope with dispersion in charging ability of the photosensitive drum 1 or change in property due to long term use or alteration of the target surface potential of the photosensitive drum 1 for various modes such as density adjustment. Accordingly, in the illustrated embodiment, the grid power supply 30 is set to output voltage from 300 Volts to 1000 Volts.

Further, in the illustrated embodiment, a varistor (constant voltage generating element) 32 having rated voltage of 1200 V is connected between the shield case 2*c* of the scorotron charger 2 and an earth (grounding) of the main body (not shown) of the image forming apparatus.

Due to the presence of the varistor 32, in the condition that the poor connection between the connectors or the poor electrical contact between the contact occurs in the electrical path between the scorotron charger and the grid power supply 30 due to the long term use or the environmental change, when the photosensitive drum 1 is charged by the scorotron charger 2, since the charges generated by the corona discharging can flow into the grid electrode 2*a* and the shield case 2*c*, excessive charges can be prevented from flowing into the photosensitive drum 1.

Further, when the value of the rated voltage of the varistor 32 is selected to be equal to or greater than the control voltage value of the control device 33 for controlling the grid power supply 30, so long as the grid power supply 30 is correctly connected to the grid electrode 2*a* and the shield case 2*c*, the grid potential can be controlled without obstructing the control of the control device 33.

Further, also in the condition that the poor connection between the connectors or the poor electrical contact between the contact occurs in the electrical path between the scorotron charger and the grid power supply 30 due to the long term use or the environmental change, since the grid electrode 2*a* and the shield case 2*c* have the potential corresponding to the rated voltage of the varistor, the rated voltage value of the varistor is selected to 1200 Volts smaller than leak voltage of 1400 V between the grid electrode 2*a* and the photosensitive drum 1.

That is to say, when it is assumed that the rated voltage of the varistor is Va, maximum voltage applied to the grid electrode 2*a* and the shield case 2*c* from the grid power supply 30 is Vb and leak limit voltage between the grid electrode 2*a* and the photosensitive drum 1 is Vc, the rated voltage Va of the varistor is set to satisfy the following requirement:

$$Vb \leqq Va \leqq Vc.$$

By providing the varistor 32 having the above-mentioned construction, even if the poor connection occurs between the grid power supply 30 and the grid electrode 2*a* and the shield case 2*c*, i.e., even if the supplying of electric power to the grid electrode 2*a* and the shield case 2*c* is interrupted, the damage of the photosensitive drum 1 can be prevented. Incidentally, in such a condition, since the photosensitive drum 1 is charged with grid potential of 1200 V, the surface potential of the photosensitive drum 1 becomes greater than the desired potential in case of no poor connection.

Figure 2:
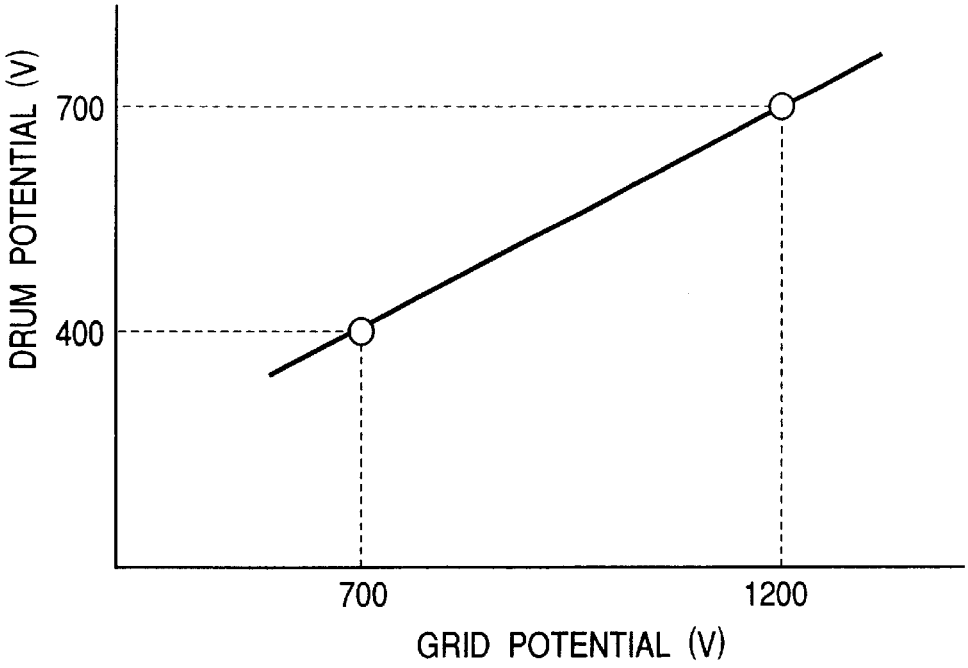
FIG. 2 is a view showing a relationship between grid potential and surface potential of a photosensitive drum (drum potential)

For example, as shown in FIG. 2, in the case where the grid power supply 30 is correctly connected to the grid electrode 2*a* and the shield case 2*c*, when the above-mentioned potential control is effected by the control device 33 to obtain desired dark potential of 400 V, the grid potential may be 700 Volts.

On the other hand, if the grid power supply 30 is not correctly connected to the grid electrode 2*a* and the shield case 2*c*, since the grid potential becomes 1200 Volts corresponding to the rated voltage of the varistor, as shown in FIG. 2, the surface potential of the photosensitive drum 1 becomes 700 Volts, which is greatly different from the desired potential, with the result that a poor image may be created or toner consumption may be increased or developer may be deteriorated or the service life of the laser of the exposure device 3 may be shortened.

To cope with this, in the illustrated embodiment, if the surface potential of the photosensitive drum 1 measured by the surface potential sensor 31 is equal to or greater than 600 Volts, the control device 33 judges that the poor connection occurs between the grid power supply 30 and the grid electrode 2*a* and the shield case 2*c* and gives warning to the operator, for example, by displaying a message "poor connection between grid power supply and grid electrode and shield case electrode" on an operating panel (not shown) of the forming apparatus. Further, in such a case, the image forming operation may be stopped.

In this way, according to the illustrated embodiment, by connecting the varistor 32 between the shield case 2*c* of the scorotron charger 2 and the earth (grounding) of the main body (not shown) of the image forming apparatus, in the condition that the poor connection or the poor electrical contact occurs between the grid power supply 30 and the grid electrode 2*a* and the shield case 2*c*, if the photosensitive drum 1 is charged, the damage of the photosensitive drum 1 can be prevented.

Further, by judging the surface potential of the photosensitive drum 1 measured by the surface potential sensor 31, the poor connection between the grid power supply and the grid electrode 2*a* and the shield case 2*c* is judged and the warning is emitted, thereby preventing the problems (that the poor image is created or the toner consumption is increased or the developer is deteriorated or the service life of the laser is shortened) regarding the poor connection between the grid power supply 30 and the grid electrode 2*a* and the shield case 2*c*.

Second Embodiment

A second embodiment of the present invention will be explained by using the image forming apparatus according to the first embodiment.

In the first embodiment, while an example that, if the surface potential of the photosensitive drum 1 measured by the surface potential sensor 31 is greater than the predetermined value, it is judged that the poor connection occurs between the grid power supply and the grid electrode 2*a* and the shield case 2*c* was explained, judgement using magnitude of one surface potential of the photosensitive drum 1 may not be correct, because, for example, even if a distance (gap) between the discharge wire electrode 2*b* and the grid electrode 2*a* of the scorotron charger 2 and the photosensitive drum 1 is small or even if the pre-exposure lamp 8 is not lighted, the surface potential of the photosensitive drum becomes great.

Thus, in the second embodiment, as the grid potential, plural different grid potentials are outputted, and the surface potentials of the photosensitive drum 1 in respective cases are measured by the surface potential sensor 31. The other constructions and operations are the same as those of the first embodiment.

When the grid power supply 30 is correctly connected to the grid electrode 2*a* and the shield case 2*c*, the surface potential of the photosensitive drum 1 is varied with the magnitude of the grid potential. To the contrary, if there is any poor connection between the grid power supply 30 and the grid electrode 2*a* and the shield case 2*c*, when the plural different grid potentials try to be outputted, since the grid potential is determined to the certain value by the varistor 32, the surface potential of the photosensitive drum 1 is not changed.

For example, the output voltage of the grid power supply is changed from 500 Volts to 700 Volts, and the surface potentials of the photosensitive drum 1 in respective cases are measured by the surface potential sensor 31. In this case, if the measured value are 300 Volts and 400 Volts which greatly differ from the aforementioned grid potential values (500 Volts and 700 Volts), the control device 33 judges that the grid power supply 30 is correctly connected to the grid electrode 2*a* and the shield case 2*c*. To the contrary, if the measured value are 650 Volts and 650 Volts which are near the aforementioned grid potential values (500 Volts and 700 Volts), the control device 33 judges that the grid power supply 30 is not correctly connected to the grid electrode 2*a* and the shield case 2*c*. That is to say, if the surface potential is not substantially changed with respect to the plural different output voltage value of the grid power supply, it is judged that the poor connection occurs. Incidentally, the measured values of the surface potential sensor 31 in respective cases may not be substantially the same as the aforementioned grid potential values.

That is to say, in consideration of measurement error of the surface potential sensor 31, an algorithm in which it is judged that the poor connection occurs between the grid power supply 30 and the grid electrode 2*a* and the shield case 2*c* even if the surface potential values of the photosensitive drum 1 more or less when the plural different grid potentials are outputted may be used.

In this way, also in the second embodiment, the same effect as the first embodiment can be achieved, and, in the second embodiment, further, by outputting the plural different grid potentials and by measuring the surface potentials of the photosensitive drum 1 by the surface potential sensor 31 so that the poor connection between the grid power supply 30 and the grid electrode 2*a* and the shield case 2*c* can be judged more correctly on the basis of the measured results thereby to give the warning to the operator, the problems (that the poor image is created or the toner consumption is increased or the developer is deteriorated or the service life of the laser is shortened) regarding the poor connection between the grid power supply 30 and the grid electrode 2*a* and the shield case 2*c* can be prevented.

Third Embodiment

A third embodiment of the present invention will be explained by using the image forming apparatus according to the first embodiment.

In the first embodiment, while an example that, if the surface potential of the photosensitive drum 1 measured by the surface potential sensor 31 is greater than the predetermined value, it is judged that the poor connection occurs between the grid power supply 30 and the grid electrode 2*a* and the shield case 2*c* and the warning is given to the operator was explained, in the third embodiment, if it is judged that the poor connection occurs between the grid power supply 30 and the grid electrode 2*a* and the shield case 2*c*, the warning is given to the operator, and, at the same time, the control device 33 effects control so that current (primary current) applied to the discharge wire electrode 2*b* of the scorotron charger 2 is reduced in comparison with the normal value. The other constructions and operations are the same as those of the first embodiment.

In the illustrated embodiment, when the grid power supply 30 is correctly connected to the grid electrode 2*a* and the shield case 2*c*, as is in the first and second embodiments, i.e., in a condition that the current normally applied to the discharge wire electrode 2*b* of the scorotron charger 2 is controlled to 1000 $\mu$A by the control device 33, if it is judged that the poor connection occurs between the grid power supply 30 and the grid electrode 2*a* and the shield case 2*c*, the control device 33 effects control so that the current applied to the discharge wire electrode 2*b* is reduced to 700 $\mu$A.

The reason why the current applied to the discharge wire electrode 2*b* of the scorotron charger 2 is reduced if it is judged that the poor connection occurs between the grid power supply 30 and the grid electrode 2*a* and the shield case 2*c* is as follows:

That is to say, when the grid power supply 30 is correctly connected to the grid electrode 2*a* and the shield case 2*c*, i.e., in the condition that the current (primary current) normally applied to the discharge wire electrode 2*b* is controlled to 1000 $\mu$A, the grid potential for obtaining the desired dark potential of 400 V is about 700 Volts, while depending upon the charging ability of the photosensitive drum 1.

On the other hand, if the poor connection occurs between the grid power supply 30 and the grid electrode 2*a* and the shield case 2*c*, as described in connection with the first embodiment, the grid potential is maintained to 1200 Volts by the action of the varistor 32. In this case, the surface potential of the photosensitive drum 1 becomes 700 Volts, with the result that if the image forming apparatus continues to be used, there will arise the aforementioned problems (that the poor image is created or the toner consumption is increased or the developer is deteriorated or the service life of the laser is shortened).

Figure 3:
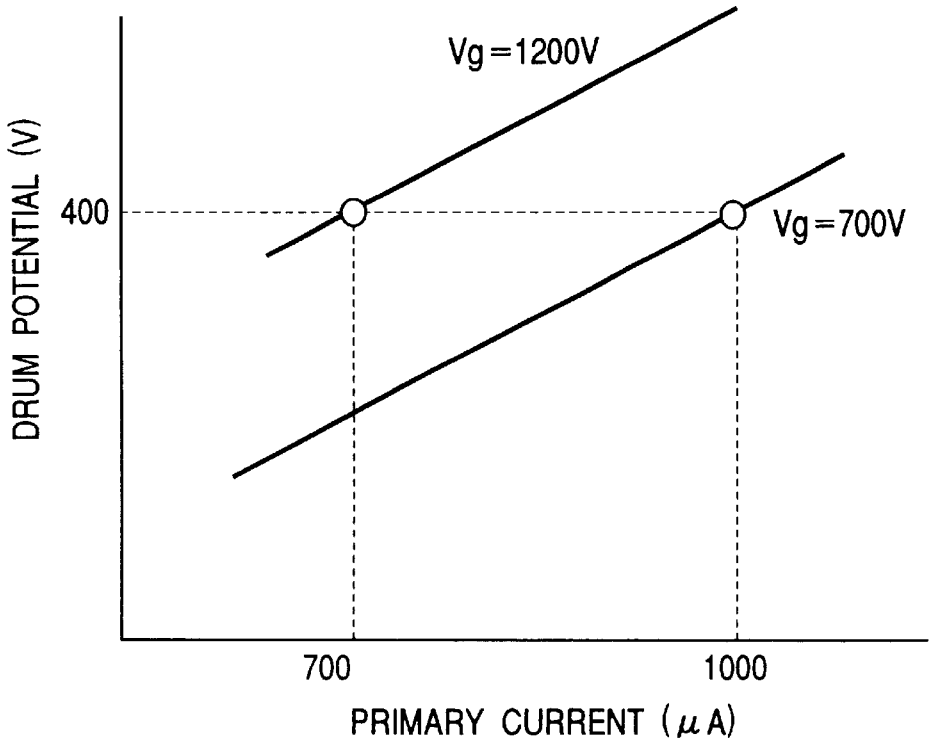
FIG. 3 is a view showing a relationship between primary current and surface potential of a photosensitive drum (drum potential)
Figure 4:
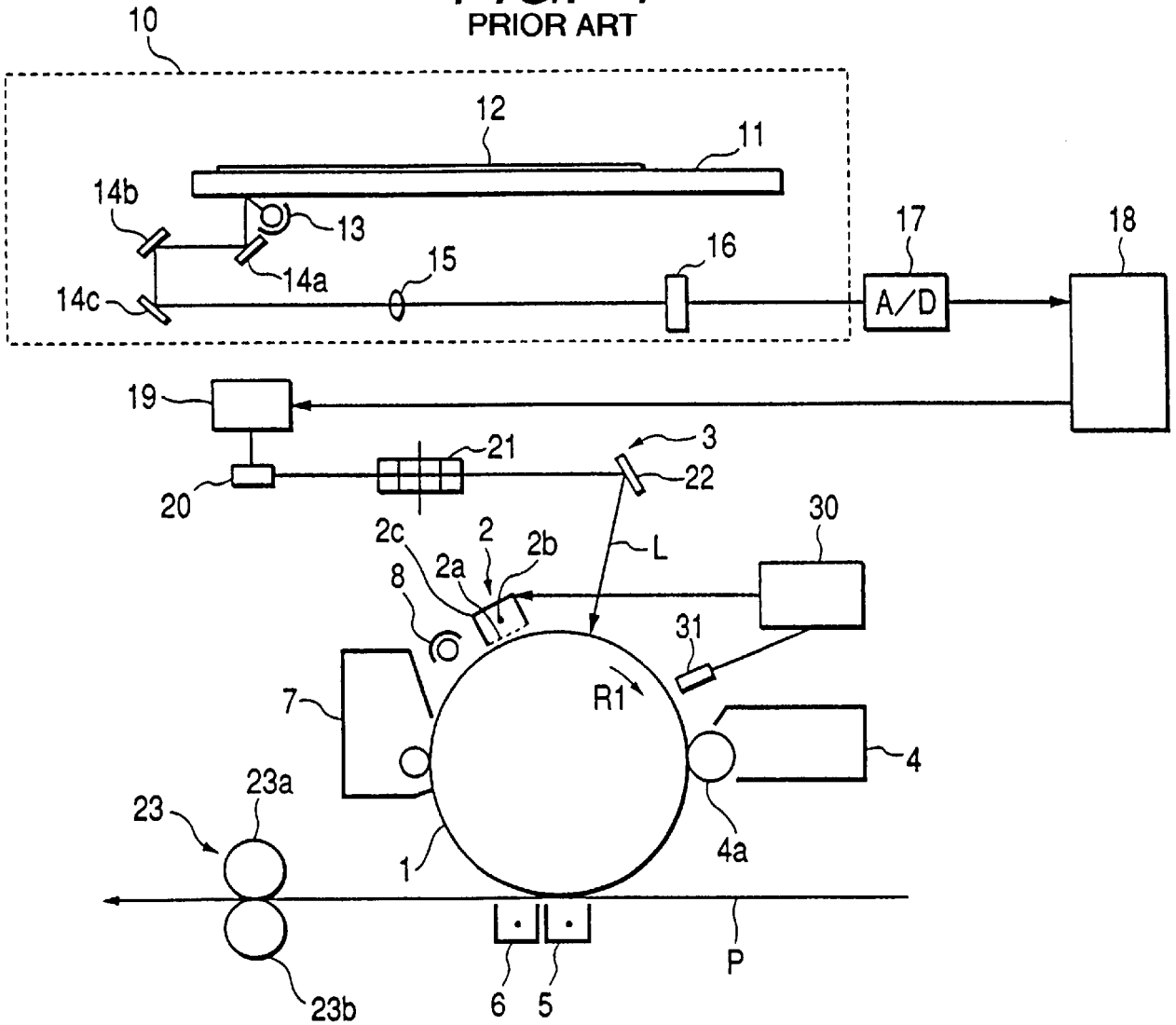
FIG. 4 PRIOR ART
FIG. 4 is a schematic constructural view of a conventional image forming apparatus.

To avoid this, in the third embodiment, as mentioned above, the control is effected so that the current applied to the discharge wire electrode 2*b* of the scorotron charger 2 is reduced to 700 $\mu$A. As a result, as shown in FIG. 3, since the surface potential of the photosensitive drum 1 (drum potential) is charged to about 400 Volts, extremely bad images are not created, and, thus, even when the image forming operation is continued in this condition, the aforementioned problems (that the poor image is created or the toner consumption is increased or the developer is deteriorated or the service life of the laser is shortened) do not arise.

Incidentally, in the illustrated embodiment, while an example that, if the poor connection occurs between the grid power supply 30 and the grid electrode 2*a* and the shield case 2*c*, the control is effected so that the current applied to the discharge wire electrode 2*b* of the scorotron charger 2 is reduced from 1000 $\mu$A to 700 $\mu$A was explained, the actual surface potential of the photosensitive drum 1 does not necessarily become the desired potential of 400 Volts due to dispersion in charging ability of the photosensitive drum 1. Thus, if the poor connection occurs between the grid power supply 30 and the grid electrode 2*a* and the shield case 2*c*, the surface potential of the photosensitive drum 1 may be measured by the surface potential sensor 31 and feedback control may be effected the current applied to the discharge wire electrode 2*b* of the scorotron charger 2, thereby controlling the surface potential of the photosensitive drum 1 more accurately.

In this way, also in the third embodiment, the same effect as the first embodiment can be achieved, and, in the third embodiment, further, by properly reducing the current applied to the discharge wire electrode 2*b* of the scorotron charger 2 if the poor connection occurs between the grid power supply 30 and the grid electrode 2*a* and the shield case 2*c*, the poor image can be prevented even when the image forming operation is continued in this condition.

What is claimed is:

1. A corona charging apparatus for charging a body to be charged, comprising:

a discharge wire electrode to which a voltage is applied;

a shield electrode having an opening opposed to said body to be charged;

a grid electrode disposed in said opening;

a power supply for applying a voltage between said grid electrode and a ground; and a constant voltage generating element electrically connected to said grid electrode, said constant voltage generating element generating a predetermined voltage when current flows into said constant voltage generating element;

wherein a rated voltage of said constant voltage generating element is equal to or greater than the voltage applied to said grid electrode from said power supply.

2. A corona charging apparatus according to claim 1, wherein said grid electrode and said shield electrode are electrically communicated with each other to have the same potential.

3. A corona charging apparatus according to claim 1, wherein said constant voltage generating element is a varistor.

4. An image forming apparatus comprising:

an image bearing member;

a corona charging apparatus for charging said image bearing member, including a discharge wire electrode to which a voltage is applied, a shield electrode having an opening opposed to said image bearing member, a grid electrode disposed in said opening, a power supply for applying a voltage between said grid electrode and a ground, and a constant voltage generating element electrically connected to said grid electrode, said constant voltage generating element generating a predetermined voltage when current flows into said constant voltage generating element, wherein a rated voltage of said constant voltage generating element is equal to or greater than the voltage applied to said grid electrode from said power supply;

detecting means for detecting a surface potential of said image bearing member; and control means for effecting control in such a manner that, when the surface potential detected by said detecting means is smaller than a predetermined value, the current supplied to said discharge wire electrode is controlled to be a first value, and, when the surface potential detected by said detecting means is equal to or greater than the predetermined value, the current supplied to said discharge wire electrode is controlled to be a second value that is smaller than the first value.

5. An image forming apparatus according to claim 4, wherein said control means controls the voltage applied to said grid electrode from said power supply, in accordance with the surface potential detected by said detecting means.

6. An image forming apparatus according to claim 4, wherein said grid electrode and said shield electrode are electrically communicated with each other to have the same potential.

7. An image forming apparatus according to claim 4, wherein said constant voltage generating element is a varistor.

8. An image forming apparatus according to claim 4, wherein said image bearing member is an amorphous silicon photosensitive member.

9. An image forming apparatus comprising:

an image bearing member;

a corona charging apparatus for charging said image bearing member, including a discharge wire electrode to which voltage is applied, a shield electrode having an opening opposed to said image bearing member, a grid electrode disposed in said opening, a power supply for applying a voltage between said grid electrode and a ground, and a constant voltage generating element electrically connected to said grid electrode, said constant voltage generating element generating a predetermined voltage when current flows into said constant voltage generating element, wherein a rated voltage of said constant voltage generating element is equal to or greater than the voltage applied to said grid electrode from said power supply; and detecting means for detecting surface potential of said image bearing member;

wherein when the surface potential detected by said detecting means is equal to or greater than a predetermined value, a condition that the surface potential is equal to or greater than the predetermined value is informed or an image forming operation is stopped.

10. An image forming apparatus according to claim 9, wherein said control means controls the voltage applied to said grid electrode from said power supply, in accordance with the surface potential detected by said detecting means.

11. An image forming apparatus according to claim 9, wherein said grid electrode and said shield electrode are electrically communicated with each other to have the same potential.

12. An image forming apparatus according to claim 9, wherein said constant voltage generating element is a varistor.

13. An image forming apparatus according to claim 9, wherein said image bearing member is an amorphous silicon photosensitive member.

* * * * *

UNITED STATES PATENT AND TRADEMARK OFFICE

CERTIFICATE OF CORRECTION

PATENT NO. : 6,345,159 B1
DATED : February 5, 2002
INVENTOR(S) : Kazuo Suzuki

It is certified that error appears in the above-identified patent and that said Letters Patent is hereby corrected as shown below:

Column 2,
Line 38, "is" should read -- are --.

Column 3,
Line 51, "constructural" should read -- constructional --; and
Line 60, "constructural" should read -- constructional --.

Column 4,
Line 2, "constructural" should read -- constructional --.

Column 6,
Line 54, "value" should read -- values --; and
Line 59, "value" should read -- values --.

Column 8,
Line 34, "effected" should read -- effected by --.

Signed and Sealed this

Twenty-first Day of May, 2002

*Attest:*

*Attesting Officer*

JAMES E. ROGAN
*Director of the United States Patent and Trademark Office*